United States Patent [19]

Krawietz

[11] Patent Number: 4,843,809

[45] Date of Patent: Jul. 4, 1989

[54] METHOD OF AUTOMATICALLY EXCHANGING SPINNING BOBBIN TUBES IN A SPINNING MACHINE

[75] Inventor: Stefan Krawietz, Ebersbach/Fils, Fed. Rep. of Germany

[73] Assignee: Zinser Textilmaschinen GmbH, Fed. Rep. of Germany

[21] Appl. No.: 280,667

[22] Filed: Dec. 6, 1988

[30] Foreign Application Priority Data

Dec. 8, 1987 [DE] Fed. Rep. of Germany ..... 3741434

[51] Int. Cl.[4] ..... D01H 9/02; D01H 9/04

[52] U.S. Cl. ..... 57/267

[58] Field of Search ..... 57/266, 267

[56] References Cited

U.S. PATENT DOCUMENTS

| | | | |
|---|---|---|---|
| 745,188 | 11/1903 | Illingworth | 57/267 |
| 993,565 | 5/1911 | Stell | 57/267 |
| 1,035,403 | 8/1912 | Armitage | 57/267 |
| 1,164,412 | 12/1915 | Shackleton | 57/267 |
| 1,419,192 | 6/1922 | Alderman | 57/267 |
| 1,639,968 | 8/1927 | Rhodes et al. | 57/267 |
| 2,262,144 | 11/1941 | Kimpton | 57/267 |

FOREIGN PATENT DOCUMENTS

| | | |
|---|---|---|
| 1292563 | 12/1964 | Fed. Rep. of Germany . |
| 2155118 | 5/1971 | Fed. Rep. of Germany . |
| 3100395 | 9/1981 | Fed. Rep. of Germany . |
| 60-126334 | 5/1985 | Japan . |

*Primary Examiner*—Donald Watkins

*Attorney, Agent, or Firm*—Shefte, Pinckney & Sawyer

[57] ABSTRACT

In a spinning machine of the type having plural spinning stations each including a drafting system, a bobbin spindle and a coaxial funnel, the automatic exchange of empty bobbin tubes for fully wound bobbin tubes on the spindles is accomplished by interrupting the spinning operation without yarn breakage or severing, separating the spindles and funnels axially and radially from one another, removing the fully wound bobbin tubes and placing empty bobbin tubes on the spindles, engaging the still unbroken yarns with the empty bobbin tubes, then severing the yarns between the removed fully wound bobbin tubes and the replacement empty tubes, and repositioning the funnels and spindles and resuming spinning operation.

15 Claims, 5 Drawing Sheets

METHOD OF AUTOMATICALLY EXCHANGING SPINNING BOBBIN TUBES IN A SPINNING MACHINE

BACKGROUND OF THE INVENTION

The present invention relates to method of automatically removing fully wound bobbin tubes and replacing them with empty bobbin tubes in a textile spinning machine of the type having a plurality of spinning stations, each of which includes a yarn drafting system, a spindle for receiving a bobbin tube and a funnel coaxial with and extending over the spindle for applying yarn from the drafting system for winding about the bobbin tube.

Textile spinning machines of the aforementioned type provide the advantage of being capable of operation at approximately three times the production speed of ring spinning machines. As a natural result, the bobbin tubes about which the spun yarn is wound become fully wound in a correspondingly more rapid manner than in ring spinning machines and, in turn, the bobbin tubes must be exchanged more frequently.

Accordingly, a need exists for a method of exchanging fully wound bobbin tubes with empty bobbin tubes in such funnel-type spinning machines in a rapid and reliable manner utilizing an exchange mechnism of simple contruction.

SUMMARY OF THE INVENTION

Briefly summarized, the present invention provides such a bobbin exchange method by performing the basic steps of initially interrupting spinning operation of the spinning machine while maintaining unbroken the several yarns being simultaneously spun and the separating the spindles and the funnels from one another in an axial direction followed by separating the spindles and funnels from one another in a radial direction. The fully wound bobbin tubes are then removed from the spindles and empty bobbin tubes are placed on the spindles while still maintaining the yarns unbroken. The years are engaged with the empty bobbin tubes in the area of the spindles and then the yarns are severed between the removed fully wound bobbin tubes and the empty bobbin tubes. After the spindles and funnels are repositioned in relative spinning disposition with each funnel coaxial with and extending over the respectively associated spindle, the spinning operation is resumed.

A rapid and reliable exchange of the spinning bobbins can be performed according to the method of this invention. The connection of the yarns between the fully-wound spinning bobbins and the respectively associated drafting systems is preserved initially by means of the funnels and then later the yarn ends are automatically connected to the empty replacement bobbin tubes, such that the present method may be readily incorporated into the control program of a spinning machine.

According to a further aspect of the present invention, the yarns are clamped on the spindles when the empty bobbin tubes are placed thereon. Thus, it is unnecessary to provide special yarn holding or yarn catching devices to secure the yarn ends in position.

It is preferred in the performance of the method of the present invention that the spindles and the funnels execute only one of their relative movements at a time, i.e. relative axial movement or relative radial movement. This results in a clear division of the associated drives. Since relative movement between the funnel and the spindle is necessary in any event as a part of the normal bobbin winding process, it is advantageous if the movable element, normally the spindle, is utilized to execute the separating movement in advance of the doffing operation in the present method. It is additionally advantageous that the relative radial separation of the spindles and the funnels be preformed by moving the funnels toward a central area of the spinning machine where sufficient space is available to accommodate this movement.

Preferably, a reserve extent of each yarn is formed in the area between each fully wound bobbin tube and the respectively associated drafting system in order to accommodate clamping of the yarns as aforementioned or possibly underwinding of the yarns on the respective fully wound bobbin tubes. The reserve yarn extents may be formed after the interruption of the spinning operation by pulling a portion of each yarn off its fully wound bobbin tube. Alternatively, the reserve yarn extents may be formed in advance of the spinning interruption. Upon resumption of the spinning operation, the remainder of each reserve yarn extent is released and wound onto the respectively associated empty bobbin tube.

To accommodate one possible embodiment of the present method, a pair of receptacles adapted for holding bobbin tubes is mounted in association with each funnel and an empty bobbin tube is retained by a first receptacle of each receptacle pair. When the spindles and funnels are radially separated, the second receptacle of each receptacle pair is positioned in axial alignment with the respectively associated spindle. To remove the fully wound bobbin tubes, the spindles and the associated second receptacles are moved axially toward one another to engage and retain the fully wound bobbin tubes on the spindles by the associated second receptacles, following which the spindles and the associated second receptacles are axially separated to remove the fully wound bobbin tubes from the spindles. To then place the empty bobbin tubes on the spindles, the first receptacle of each receptacle pair is positioned in axial alignment with the respectively associated spindle and the spindles and associated first receptacles are moved axially toward one another to dispose the empty bobbin tubes retained by the first receptacles on the respectively associated spindles. The empty bobbin tubes are then released from the first receptacles and the spindles and the associated first receptacles are axially separated from one another. Thereafter, the funnels are again positioned in coaxial spinning disposition over the respectively associated spindles and the spinning operation is resumed. Preferably, the fully wound bobbin tubes are removed from the second receptacles after the spinning operation has been resumed.

In this embodiment, after the fully wound bobbin tubes have been removed from spindles and before the spindles and the first receptacles are moved toward one another, an extent of each yarn trailing from the associated fully wound bobbin tube is placed transversely over an end of the associated empty bobbin tube facing the associated spindle. Each of the first and second receptacles of each receptacle pair are preferably constructed for gripping an outwardmost end of each bobbin tube facing away from the spindles to facilitate the steps of retaining the empty and fully wound bobbin tubes.

In this embodiment of the present method, the movements required for exchange of full and empty bobbin tubes are advantageously limted to a minimum. The empty replacement bobbin tubes are already held by the receptacles associated with each spinning funnel to be ready for the exchange operation and, during the performance of the actual exchange, the full bobbin tubes, once removed from the spindles, need not be transported completely away from the area of the spindles. Once the exchange is completed, the spinning operation can be immediately resumed and thereafter the fully wound bobbin tubes can be removed from the receptacles and a new set of empty replacement bobbin tubes introduced to the receptacles in preparation for the next exchange operation.

DESCRIPTION OF THE PREFERRED EMBODIMENT

Figure 3:
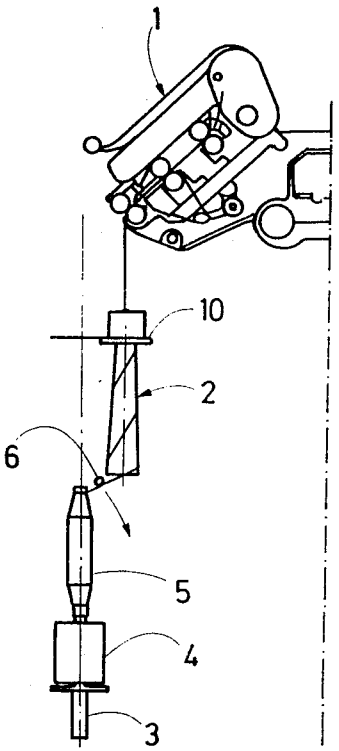
FIGS. 1–7 are side elevational views of an individual spinning station in a spinning machine having a plurality of such spinning stations, illustrating sequential stages in a first embodiment of the bobbin tube exchange method of the present invention.

Referring now to the accompanying drawings, each drawing illustrates a single spinning station of a textile spinning machine of the type having a plurality of adjacent spinning stations linearly aligned in a row along the spinning machine, preferably at both opposite longitudinal sides of the machines. Each spinning station includes a drafting mechanism, broadly indicated at 1, to which a roving is fed from a roving bobbin or other suitable supply (not shown), the drafting mechanism operating to draw the roving to a predetermined extent to produce a yarn of a desired fineness. Each spinning station additionally is provided with an upright spindle 3 driven by an individual drive motor 4. A bobbin tube is coaxially supported on the spindle 3 for winding of the spun yarn peripherally about the bobbin tube, the composite package of the wound yarn and the supporting bobbin tube commonly being known as a bobbin, indicated by the reference numeral 5. The spun yarn is fed progressively to the bobbin 5 via a generally conical funnel member 2, commonly referred to as a bell, positioned coaxially to the spindle 3 and extending over the spindle 3 and the supported bobbin 5 during the normal spinning operation. The funnel 2 is provided with an axial yarn inlet at its upper end coaxial with the spindle 3 to serve as a guide conduit for the spun yarn. Another conduit section extends radially outwardly from the axial yarn guide conduit, normally at an inclination in the direction of yarn travel, and opens to the outer periphery of the funnel 2. Thus, the spun yarn enters the funnel 2 axially through the axial yarn guide conduit, moves radially outwardly therefrom through the radial conduit section, then travels downwardly in a helical manner along the outer periphery of the funnel 2 and is directed about the lowermost edge of the funnel onto the bobbin 5 of winding thereabout.

The funnel 2 is normally mounted in a freely rotatable manner so that the funnel 2 rotates in response to the helical traveling movement of the yarn along the outer funnel periphery. However, it is also possible to positively drive and/or brake the funnel, as necessary or desirable.

The spun yarn of the bobbin 5 is wound in a so-called cop build-up pattern onto the bobbin tube which is set coaxially on the spindle 3. For this purpose, an appropriate relative movement of the spindle 3 and the funnel 2 axially with respect to one another is carried out over the course of the bobbin winding operation to apply the spun yarn to the bobbin 5 in a vertically reciprocating back-and-forth motion which gradually shifts to the upper end of the bobbin. In the embodiment shown, the vertical back-and-forth motion is accomplished by alternately raising and lowering the spindle 3 together with its drive motor 4 relative to the funnel 2.

Figure 2:
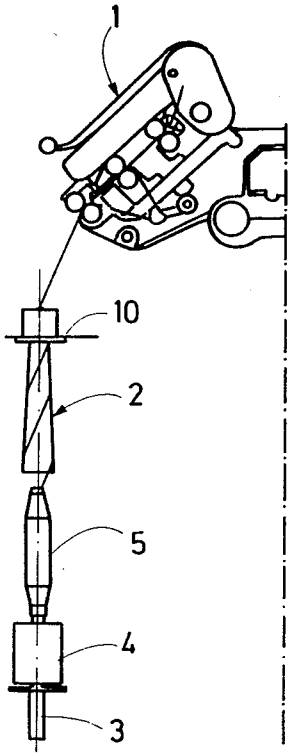
Figure 1:
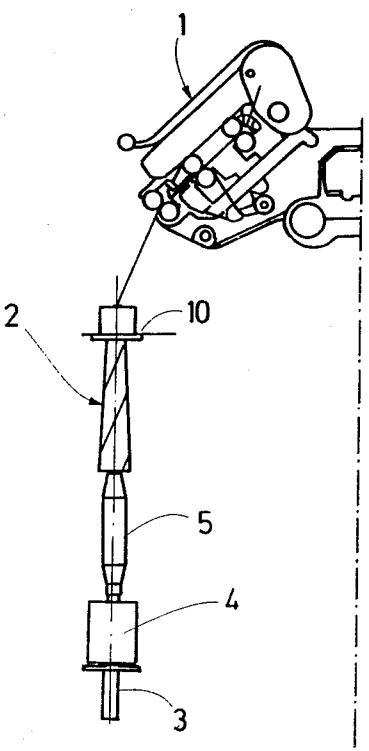

When the bobbin 5 has been wound with yarn to its full capacity, the bobbin 5 and the funnel 2 will be in the relative positions shown in FIG. 1. At this point, the spinning operation is interrupted so that a bobbin exchange operation can be initiated. For this purpose, the spindles 3 and the funnels 2 are initially moved away from one another in an axial direction, preferably by lowering the spindles 3 relative to the funnels 2, to a sufficient extent that the upper ends of the bobbins 5 are spaced below the lower edges of the respective funnels 2, as shown in FIG. 2. In doing so, a corresponding length of the yarn is pulled off each bobbin 5 so that no breakage of the yarn occurs (FIG. 2). The funnels 2 and their holders 10 are then shifted as a unit radially with respect to the spindles 3 inwardly toward the central area of the spinning machine, as shown in FIG. 3. At the same time, a yarn engaging element 6, which for example may be a bent wire member formed in an inverted V-shape, is moved into contact with the portion of each yarn extending between the associated bobbin 5 and funnel 2. The yarn engaging element 6 is then moved obliquely downwardly and inwardly toward the central area of the spinning machine as indicated by the directional arrow in FIG. 3 until the element 6 reaches a final resting disposition approximately horizontally adjacent the lower ends of the supporting tubes of the bobbins 5 slightly above a shoulder portion on which each bobbin tube rests on the associated spindle 3 and on which an empty replacement bobbin tube will subsequently be rested. (See FIG. 4).

A conveyor belt or other suitable bobbin tube transport device, representatively indicated at 7, extends along each side of the spinning machine and is provided at regular intervals with upwardly projecting bobbin tube support pins. Empty replacement bobbin tubes 9 are placed on alternate ones of the support pins with the intervening pins being left free. A suitable bobbin gripping transfer device is moved into position for grasping the fully wound bobbins 5 in the position of FIG. 3 and is then moved to remove the bobbins 5 from the spindles 3 and to deposit the bobbins 5 on the free pins of the transport conveyor 7, as representatively shown in FIG. 4. A known type of such transfer device 8 suitable for this purpose is utilized in conventional ring spinning machines. During this operation, the extent of the yarns between the drafting system 1 and the bobbins 5 remains uninterrupted and unbroken. The extent of the yarns extending from the lower edge of the funnels 2, about the yarn guide element 6 and to the upper end of the bobbins 5 on the conveyor 7 forms a reserve of each yarn, as shown in FIG. 4.

Once the removed bobbins 5 have been placed on the conveyor 7, it is then moved an incremental distance equivalent to the spacing between adjacent spindles, whereby the yarns are deflected somewhat from the spindle 3 to be located in a defined position relative thereto without breaking the yarns. The transfer device 8 is then operated to remove the empty bobbin tubes 9 from the conveyor 7 and to place each tube 9 coaxially on a respective spindle 3, as shown in FIG. 5. In doing so, the extent of each yarn between the yarn engaging element 6 and the upper end of the respective bobbin 5 just removed is clamped securely on the respective spindle 3 by the lower end of the replacement bobbin tube 9. Each yarn is then severed along its extent between the empty bobbin tube 9 and the removed bobbin 5 by a suitable cutting device, shown only schematically in FIGS. 5 at 17, after which the full bobbins 5 can be transported away from the spinning machine by the conveyor 7.

Figures 4, 5, 6, 7:
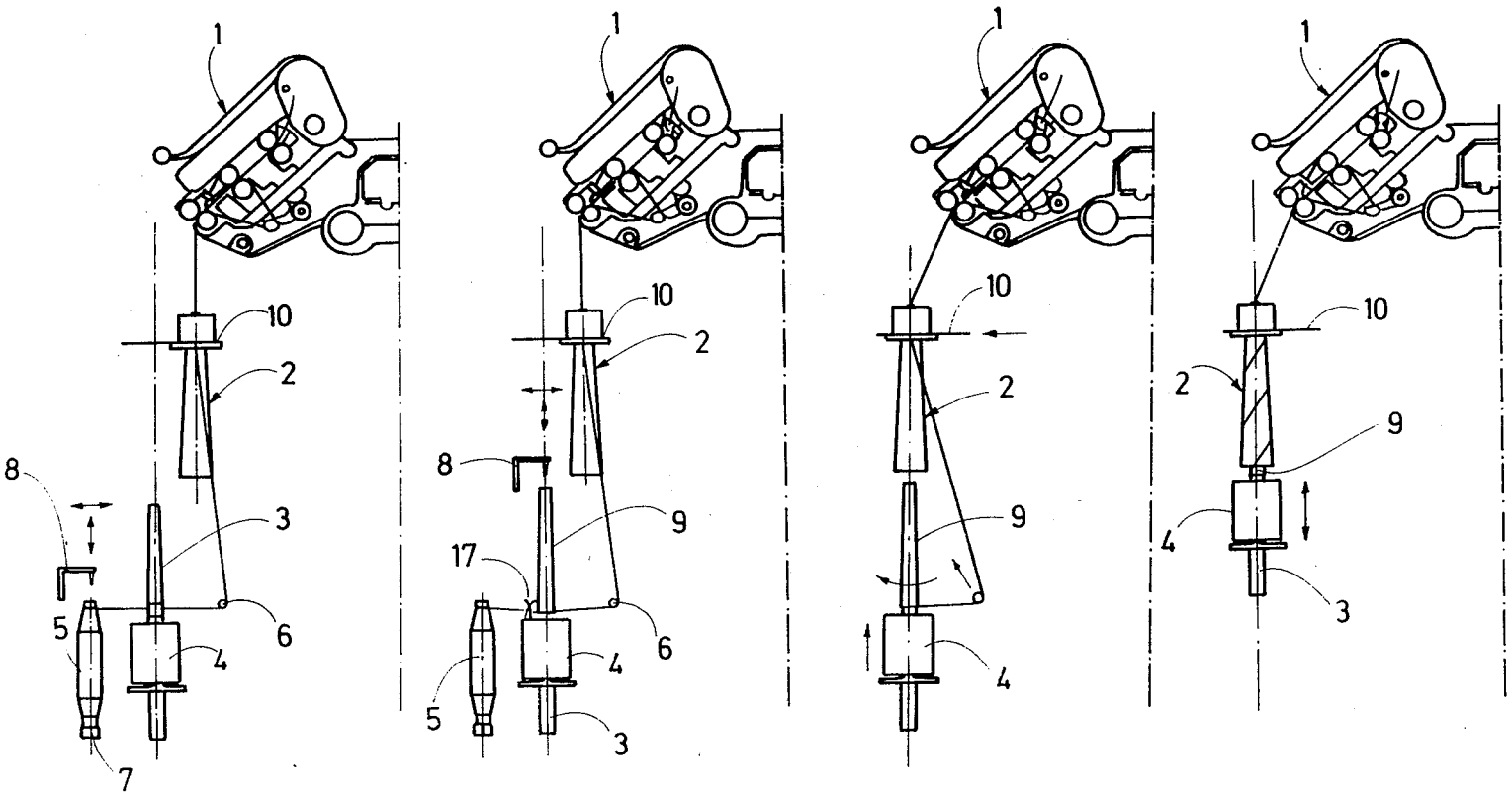

A new empty replacement bobbin tube 9 having been placed onto each spindle 3, the drive motors 4 of the spindles 3 are reactivated and, simultaneously, the yarn engagement elements 6 are withdrawn away from the area of the spinning stations, as represented by the directional arrows in FIG. 6. The spindle 3 and its motor 4 is then moved upwardly to extend coaxially into the funnel 2 and the drafting system 1 is also reactivated, thereby resuming the spinning operation with the spun yarn traveling helically along the outer periphery of the funnel 2 for winding application about the empty bobbin tube 9, all as representatively shown in FIG. 7. In normal fashion, the spindle 3 is moved vertically back-and-forth with respect to the funnel 2 to build the wound yarn on the bobbin tube 9 in the desired aforementioned fashion, while the funnel 2 rotates only in response to the traveling movement of the yarn.

Figure 10:
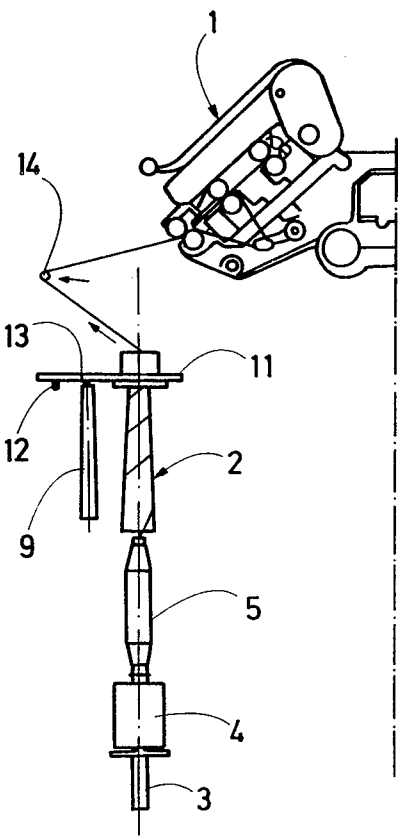
FIGS. 8–16 are similar side elevational view of an individual spinning station showing sequential stages in the performance of another embodiment of bobbin tube exchange operation according to the present method.
Figure 9:
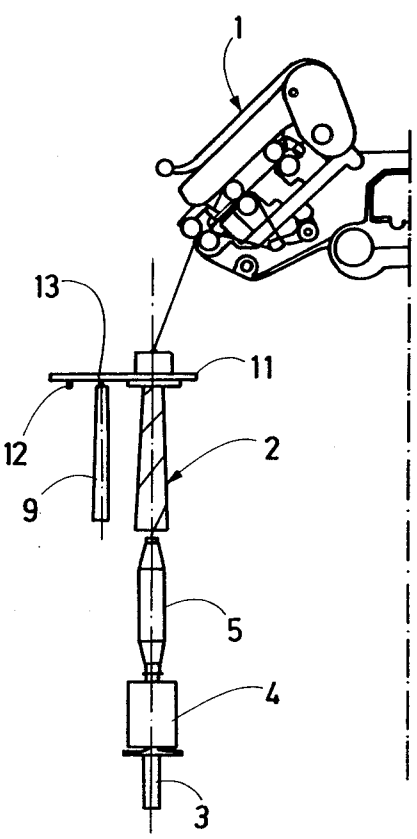
Figure 8:
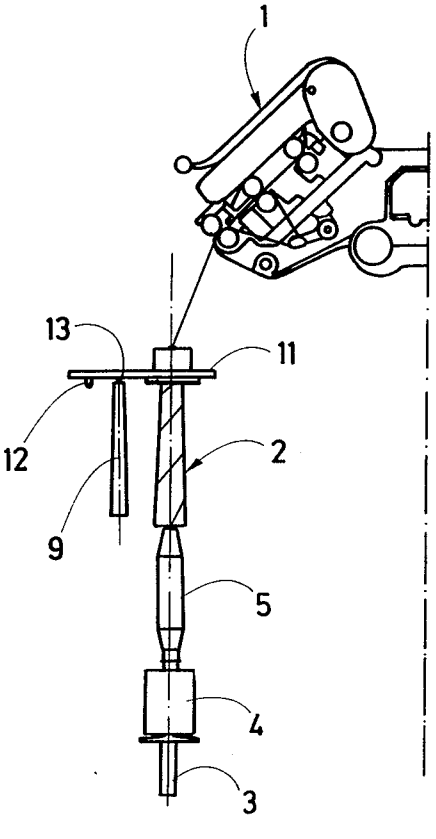
Figure 12:
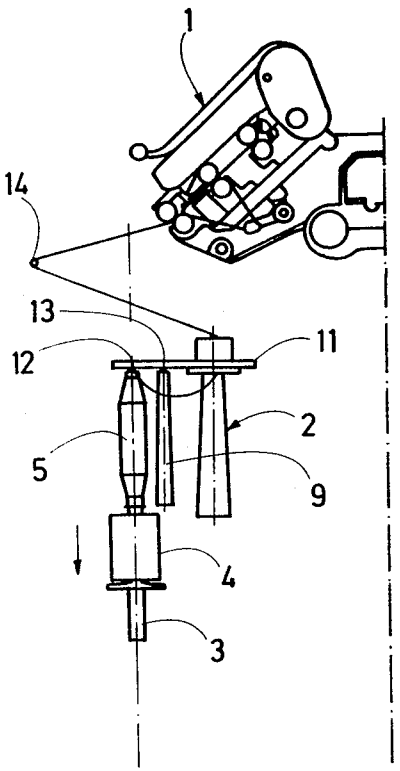
Figure 11:
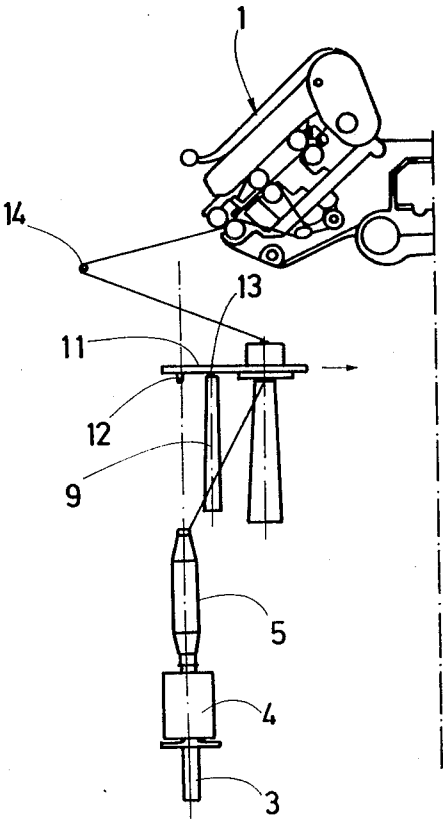

FIGS. 8–16 depict another embodiment of the bobbin exchange method of the present invention. Since the individual spinning positions of the spinning machine in such embodiment do not differ in principle from the spinning positions of the above-described embodiment of FIGS. 1–7, the corresponding elements in FIGS. 8–16 are identified by the same reference numerals. In this embodiment, each spinning position differs only in that the holders 11 for the funnnels 2 are provided with a pair of receptacles 12, 13 for each spinning station. An empty bobbin tube 9 is held by each receptacle 13 immediately adjacent to the associated funnel 2 for the respective spinning station. After the bobbin 5 in spinning operation is wound to its fully capacity, the spinning operation is stopped with the funnel 2, the spindle 3 and the bobbin 5 at each spinning station in the relative dispositions shown in FIG. 8. The funnel 2 and the spindle 3 are separated axially from one another by lowering the spindle 3 and its motor 4 to a spacing below the lower edge of the funnel 2, as shown in FIG. 9. A yarn engaging element 14 located between the drafting system 1 and the upper yarn inlet side of the funnels 2 is then moved outwardly away from the spinning machine obliquely with respect to the travel path of the yarns to engage and pull a portion of each yarn off its associated full bobbin 5, forming a reserve extent of each yarn in the area between the drafting systems 1 and the funnels 2, as shown in FIG. 10. Either during or after this formation of the reserve extent of the yarns, the holders 11 of the funnels 2 are moved radially with respect to the spindles 3 in the direction inwardly toward the central area of the spinning machine until the free receptacle 12 of each holder 11 is located vertically above the respective spindle 3, as shown in FIG. 11. In doing so, each yarn is pulled from its helical disposition on the outer periphery of its funnel 2. The spindles 3 are next raised until the upper end of the bobbin tube of each full bobbin 5 is engaged with the associated free receptacle 12 positioned thereabove, as shown in FIG. 12. Each receptacle 12 includes gripper elements which are configured and adapted to extend interiorly within a bobbin tube and engage behind a compatible corresponding inner annular flange of a bobbin tube so as to hold a bobbin tube securely. Accordingly, when the receptacles 12 are engaged by the upper end of the respective full bobbins 5, the receptacles 12 grip and securely retain the bobbins 5 when the spindles 3 are subsequently lowered. The gripper elements are further adapted to release a bobbin tube when the tube is raised with respect to the receptacle 12. Such gripper elements are known, for example, in holding devices for roving bobbins.

Figure 13:
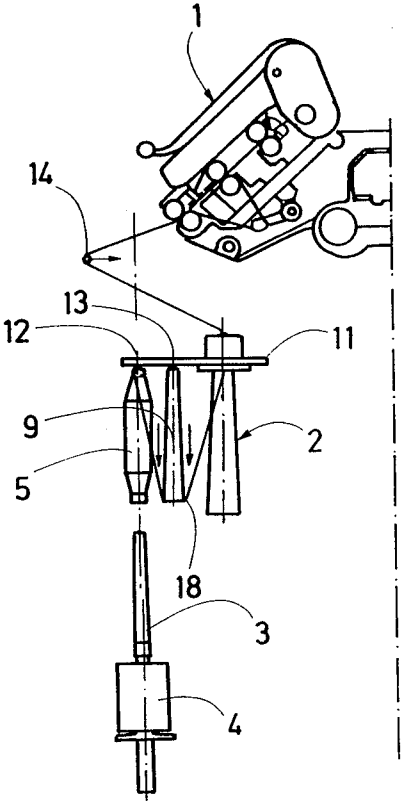

After the fully wound bobbins 5 have been engaged and gripped by the receptacles 12 to transfer the bobbins 5 to the holders 11, the spindles 3 are again lowered until they are completely free of the full bobbins 5, as shown in FIG. 13. The extent of each yarn between the upper end of its full bobbin 5 and its funnel 2 is then drawn downwardly by means of suitable guide elements, representatively indicated at 18, to dispose each yarn transversely across the lower edge of the associated empty bobbin tube held in the holder 11. The guide element 18 performing this operation may, for example, be a ring having V-shaped indentations adapted to engage the yarn. To accommodated this operation, the yarn engaging element 14 is moved in reverse toward the spinning machine to release a portion of each yarn reserve, as indicated by the directional arrow in FIG. 13.

Figure 16:
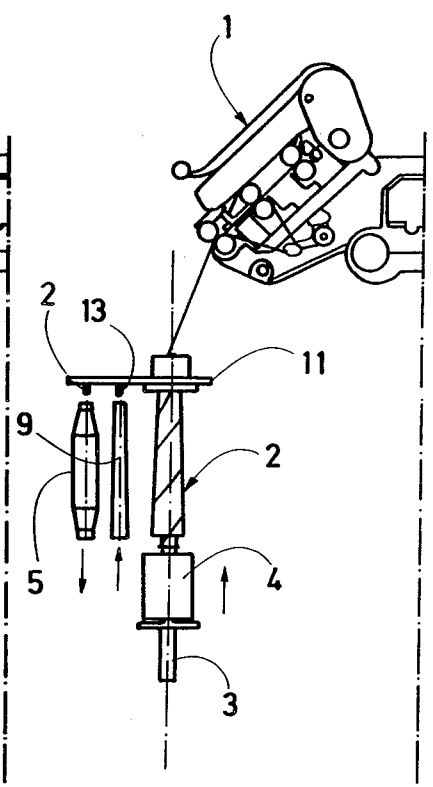
Figure 15:
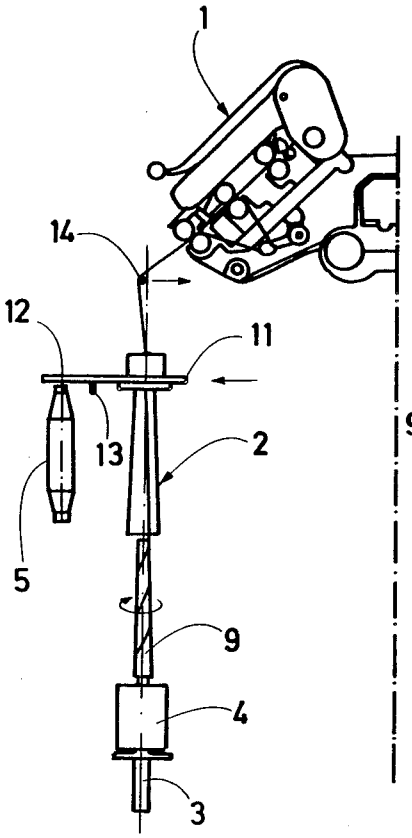
Figure 14:
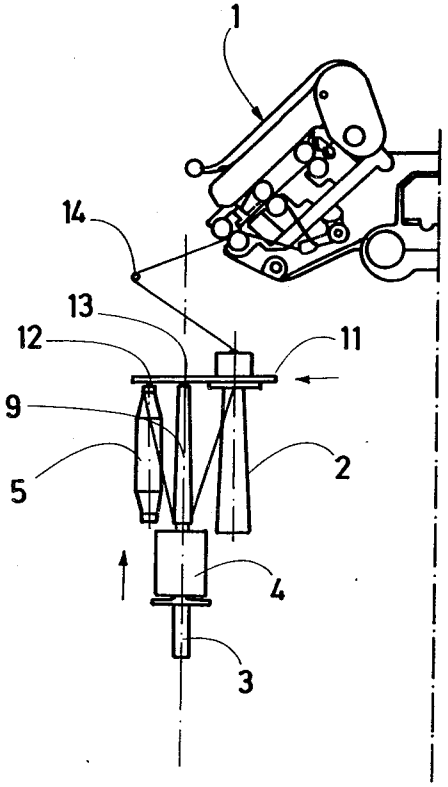

The holders 11 are then moved radially with respect to the spindle 3 a short distance outwardly away from the central area of the spinning machine to locate the empty bobbin tubes 9 vertically above the respective spindles 3 in coaxial relation therewith. The spindles 3 are then moved upwardly to extend interiorly into the bobbin tubes 9, as shown in FIG. 14. The receptacles 13 which support the bobbin tubes 9 are of substantially the same above-described construction as the receptacles 12. Thus, the empty bobbin tubes 9 are released from the receptacles 13 to rest coaxially on the spindles 3 when the spindles 3 are raised to a sufficient extent to slightly raise the bobbin tubes 9 with respect to their receptacles 13. Upon release of the empty bobbin tubes 9 onto the spindles 3, the respective portions of the yarns extending across the lower facing edges of the bobbin tubes 9 are clamped securely between the bobbin tubes 9 and the spindles 3. Thereupon, each yarn is severed along its extent between its clamped portion and its respective full bobbin 5, after which the spindles 3 with the newly received empty bobbin tubes 9 are moved downwardly, as shown in FIG. 15. The holders 11 are then moved radially withe respect to the lowered spindles 3 into the orignal disposition (FIG. 8) wherein the funnels 2 are coaxially above the spindles 3 (FIG. 15). Once this disposition is reached, the drives 4 of the spindles 3 are reactivated while simultaneously the yarn engagement element 14 is removed to its orignal disposition out of engagement with the yarns to release the remaining yarn reserve. The spindles 3 with their empty bobbin tubes 9 are then moved upwardly to penetrate into the interior of their respectively associated funnels 2 and the drafting systems 1 are reactivated to resume normal spinning operation, as indicated in FIG. 16.

Advantageously, the completion of this described exchange of fully wound bobbins 5 with empty bobbin tubes 9 requires only a relatively short time span between the initial interruption of normal spinning operation and the resumption of spinning operation, since the individual components need be moved only very short distances no more than is absolutely necessary to execute the successive steps of the exchange operation. Moreover, the final removal of the fully wound bobbins 5 from the receptacles 12, as well as the replacement of new empty bobbin tubes 9 onto the receptacles 13 in preparation for the next succeeding exchange operation, can be conveniently performed after the spinning machine is returned to normal spinning operation in the final step of FIG. 16.

As those persons skilled in the art will understand, it is normally not readily possible in spinning machines of the type using a funnel 3 rather than a ring and traveler to position a trailing yarn underwinding in the area of the lower tube end of fully wound bobbins 5 at the completion of spinning operation. In contrast, the method of the present invention advantageously makes possible the formation of yarn underwindings utilizing the reserve extent of each yarn formed in the course of the method steps represented by FIGS. 10 and 11. For this purpose, a ring or other suitable implement (not shown) is operated coaxially about each fully wound bobbin 5 during the method interval represented by FIG. 11 to guide the trailing extent of yarn from the bobbin 5 into the area of the lower end of the bobbin tube of the bobbin 5 so that an underwinding can then be formed thereat by releasing a portion of the yarn reserve formed by the yarn engaging element 14. This may be accomplished by moving the ring coaxially along the spindle axis while the bobbins 5 are in the position of FIG. 11 or by moving the spindles 3 to deliver the bobbins 5 to a stationary ring. Once the underwinding is formed, the ring is removed (or the bobbin 5 is removed from the ring) and the bobbin exchange operation is continued in the same manner as aforedescribed, the only difference being that, instead of the yarn extending from the upper end of the full bobbins 5 to the radial opening in the funnel 2 as shown in FIG. 11, the yarn insteasd extends from the underwinding to the funnel 2. Nevertheless, this difference would not result in any basic change in the performance of the subsequent steps of the bobbin exchange operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a spinning machine of the type having a plurality of spinning stations, each of which includes a drafting means, a spindle for receiving a bobbin tube and a funnel coaxial with and extending over the spindle for applying yarn from the drafting means for winding about the bobbin tube, a method of automatically removing fully wound bobbin tubes from the spindles and replacing empty bobbin tubes on the spindles, said method comprising the steps of interrupting spinning operation of the spinning machine while maintaining the yarns being spun unbroken, separating the spindles and the funnels from one another in an axial direction, separating the spindles and funnels from one another in a radial direction, removing the fully wound bobbin tubes from the spindles and placing empty bobbin tubes on the spindles while still maintaining the yarns unbroken, engaging the yarns with the empty bobbin tubes in the area of the spindles, servering the yarns between the removed fully wound bobbin tubes and the empty bobbin tubes, repositioning the funnels and spindles in relative spinning disposition with each funnel coaxial with and extending over the respectively associated spindle and resuming spinning operation.

2. The method of claim 1 and characterized further in that said engaging step includes clamping the yarns when performing the step of placing empty bobbin tubes on the spindles.

3. The method of claim 1 and characterized further in that the steps of axially separating and radially separating the spindles and the funnels are performed separately.

4. The method of claim 3 and characterized further in that said axially separating step includes axially moving the spindles and said radially separating step includes radially moving the funnels.

5. The method of claim 4 and characterized further in that said radially separating sted includes moving the funnels toward a central area of the spinning machine.

6. The method of claim 1 and characterized further by forming a reserve extent of each yarn being spun in the area between each fully wound bobbin tube and the respectively associated drafting means and forming an underwinding of a portion of each reserve yarn extent on the respective fully wound bobbin tube.

7. The method of claim 1 and characterized further by forming a reserve extent of each yarn being spun in the area between each fully wound bobbin tube and the respectively associated drafting means and releasing at least a portion of each reserve yarn extent for said engaging of the yarns with the empty bobbin tubes.

8. The method of claim 6 or 7 and characterized further in that the step of forming the reserve yarn extents is performed in advance of the interrupting of spinning operation.

9. The method of claim 6 or 7 and characterized further in that the step of forming the reserve yarn extents is performed after the interrupting of spinning operation by pulling a portion of each yarn off its fully wound bobbin tube.

10. The method of claim 6 or 7 and characterized further in that the reserve yarn extents are released upon the resuming of spinning operation by winding the remainder of each reserve yarn extent onto the respectively associated empty bobbin tube.

11. The method of claim 1 and characterized further in that, following the step of removing the fully wound bobbin tubes from the spindles, positioning each fully wound bobbin tube in an intermediate position adjacent its respectively associated spindle wherein each yarn being spun engages the associated spindle.

12. The method of claim 1 and characterized further by mounting a pair of receptacles for holding bobbin tubes in association with each funnel and retaining an empty bobbin tube by a first receptacle of each receptacle pair, the step of radially separating the spindles and funnels including positioning the second receptacle of each receptacle pair in axial alignment with the respectively associated spindle, the step of removing the fully wound bobbin tubes and placing empty bobbin tubes including moving the spindles and the associated second receptacles axially toward one another to engage and retain the fully wound bobbin tubes on the spindles by the associated second receptacles, then axially separating the spindles and the associated second receptacles to remove the fully wound bobbin tubes from the spindles, then positioning the first receptacle of each receptacle pair in axial alignment with the respectively associated spindle, moving the spindles and the associated first receptacles axially toward one another to dispose the empty bobbin tubes retained by the first receptacles on the respectively associated spindles, releasing the empty bobbin tubes from the first receptacles, and axially separating the spindles and the associated first receptacles.

13. The method of claim 12 and characterized further by, before the step of moving the spindles and first receptacles toward one another, placing an extent of each yarn being spun trailing from the associated fully spun bobbin tube transversely over an end of the associated empty bobbin tube facing the associated spindles.

14. The method of claim 12 and characterized further by, after the step of resuming spining operation, removing the fully wound bobbin tubes from the second receptacles.

15. The method of claim 12 and characterized further in that the retaining of empty and fully wound bobbin tubes by the first and second receptacles of each receptacle pair includes gripping an outwardmost end of each said tube facing away from the spindles.

* * * * *